US008658967B2

(12) United States Patent
Bezel et al.

(10) Patent No.: US 8,658,967 B2
(45) Date of Patent: Feb. 25, 2014

(54) OPTICALLY PUMPING TO SUSTAIN PLASMA

(75) Inventors: Ilya Bezel, Sunnyvale, CA (US); Anatoly Shchemelinin, Pleasanton, CA (US); Matthew Derstine, Los Gatos, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 49 days.

(21) Appl. No.: 13/529,539

(22) Filed: Jun. 21, 2012

(65) Prior Publication Data

US 2013/0001438 A1 Jan. 3, 2013

Related U.S. Application Data

(60) Provisional application No. 61/502,729, filed on Jun. 29, 2011.

(51) Int. Cl.
*H01J 19/12* (2006.01)
*H05H 1/24* (2006.01)

(52) U.S. Cl.
USPC ..... 250/251; 250/492.1; 250/526; 315/153; 315/155; 356/317; 356/320; 356/307; 372/76

(58) Field of Classification Search
USPC ..... 250/251, 492.1, 461.1, 493.1, 494.1, 250/495.1, 504 R, 526, 559.1, 578.1; 315/111.21, 111.71, 150, 153, 155; 356/256, 307, 309, 315, 316, 317, 318, 356/320; 372/76, 85, 86
See application file for complete search history.

(56) References Cited

U.S. PATENT DOCUMENTS 3,935,600 A 2/1976 Scribner
5,753,112 A 5/1998 Barnes

FOREIGN PATENT DOCUMENTS

FR 2792010 A1 10/2000
WO W02011029737 A1 3/2011

*Primary Examiner* — Bernard E Souw
(74) *Attorney, Agent, or Firm* — Suiter Swantz pc llo

(57) ABSTRACT

A method for sustaining a plasma includes providing a volume of a gas; generating illumination of a first selected wavelength; and forming a first plasma species in a first region of the gas and a second plasma species in a second region of the gas by focusing the illumination of the first wavelength into the volume of gas, the first region having a first average temperature and a first size, the second region having a second average temperature and a second size, the illumination of the first selected wavelength transmitted by the second plasma species, the illumination of the first selected wavelength absorbed by the first plasma species by tuning the first selected wavelength of the illumination to an absorption line of the first plasma species, the absorption line being associated with an ionic absorption transition or an excited neutral transition of the first plasma species.

18 Claims, 6 Drawing Sheets

OPTICALLY PUMPING TO SUSTAIN PLASMA

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of United States Provisional patent application entitled HOT PLASMAS SUSTAINED BY CW LASER IN ARGON, naming Ilya Bezel, Anatoly Shchemelinin, and Matthew Derstine as inventors, filed Jun. 29, 2011, Application Ser. No. 61/502,729.

TECHNICAL FIELD

The present invention generally relates to plasma based light sources, and more particularly to optically pumped plasma based light sources.

BACKGROUND

As the demand for smaller and smaller integrated circuit device features continues to increase, the need for improved illumination sources used for inspection of these ever-shrinking devices continues to grow. One such illumination source includes a laser-sustained plasma source. Laser-sustained plasma light sources are capable of producing high-power broadband light in the ultraviolet and visible portion of the electromagnetic spectrum. Laser-sustained light sources operate by focusing laser radiation into a gas volume in order to excite the gas, such as argon or xenon, into a plasma state, which is capable of emitting broadband light. This effect is typically referred to as "pumping" the plasma. The pump laser may include a continuous wave (CW) laser, a modulated laser source, or a pulsed laser source. In a general sense, laser-sustained plasma light sources display temperatures higher than those found in competing technologies, such as electrical discharge-sustained light sources. In turn, the higher temperatures achieved utilizing a laser-sustained plasma light source leads to a brighter light source and emitted light with shorter wavelengths.

For example, the brightness of a plasma sustained utilizing CW optical pumping is generally limited since standard laser-sustained techniques are generally insufficient. For example, merely increasing power of a pumping laser tends to merely cause the plasma to grow in size. This effect occurs because pumping light is absorbed in the cooler regions of the plasma, which tend to encompass a central hotter region of the plasma. In this sense, increasing pumping power tends to merely pump more power into cooler exterior regions of the plasma, while the core temperature of the plasma remains relatively unchanged.

Therefore, it would be desirable to provide a system and method for preferentially pumping a hotter region of the plasma, which corrects the deficiencies identified in the prior art.

SUMMARY

A method for sustaining a plasma is disclosed. In one aspect, the method may include, but is not limited to, providing a volume of a gas; generating illumination of a first selected wavelength; and forming a first plasma species in a first region of the gas and at least a second plasma species in at least a second region of the gas by focusing the illumination of the first selected wavelength into the volume of the gas, the first region having a first average temperature and a first size, the at least a second region having at least a second average temperature and at least a second size, the illumination of the first selected wavelength substantially transmitted by the at least a second plasma species, the illumination of the first selected wavelength substantially absorbed by the first plasma species by tuning the first selected wavelength of the illumination to an absorption line of the first plasma species, the absorption line being associated with at least one of an ionic absorption transition or an excited neutral transition of the first plasma species.

In another aspect, a method may include, but is not limited to, providing a volume of a gas; generating illumination including a plurality of selected wavelengths; forming a first plasma species in a first region of the gas and at least a second plasma species in at least a second region of the gas by focusing the illumination of the plurality of selected wavelengths into the volume of the gas, the first region having a first average temperature and a first size, the at least a second region having at least a second average temperature and at least a second size, the illumination having a plurality of selected wavelengths substantially transmitted by the at least a second plasma species, the illumination having a plurality of selected wavelengths substantially absorbed by the first plasma species.

In another aspect, a method may include, but is not limited to, providing a volume of a gas; generating illumination having a selected spectral range; forming a first plasma species in a first region of the gas and at least a second plasma species in at least a second region of the gas by focusing the illumination of the selected spectral range into the volume of the gas, the first region having a first average temperature and a first size, the at least a second region having at least a second average temperature and at least a second size, the illumination of the selected spectral range substantially transmitted by the at least a second plasma species and substantially absorbed by the first plasma species, the selected spectral range including one or more wavelengths corresponding to at least one of an ion absorption transition line or an excited neutral transition line of the first plasma species.

In another aspect, a method may include, but is not limited to, providing a volume of a gas; generating illumination of one or more selected wavelengths, forming one or more plasma species in a region of the gas by focusing the illumination of the one or more wavelengths into the volume of the gas, the one or more wavelengths tuned to one or more first selected absorption lines of at least one of the gas or the one or more plasma species, the one or more wavelengths corresponding to a selected portion of the electromagnetic spectrum substantially different than one or more second selected absorption lines.

An apparatus for sustaining a plasma is disclosed. In one aspect, an apparatus may include, but is not limited to, a volume for containing a gas; an illumination source configured to generate illumination of a first selected wavelength; and a first set of optics configured to focus a portion of the illumination of the first selected wavelength into the volume of gas in order to form a first plasma species in a first region of the gas and at least a second plasma species in at least a second region of the gas, the first region having a first average temperatures and a first size, the at least a second region having at least a second average temperatures and at least a second size, the illumination of the first selected wavelength substantially transmitted by the at least a second plasma species, the illumination of the first selected wavelength substantially absorbed by the first plasma species by tuning the first selected wavelength of the illumination to at least one of an ion absorption transition line or an excited neutral transition line of the second plasma species.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1A through 5, a system and method for sustaining a plasma and collecting the light emitted from the plasma are described in accordance with the present disclosure. Laser-sustained plasma light sources are general described in U.S. patent application Ser. No. 13/119,491, by Bezel et al., entitled "Multi-Wavelength Pumping to Sustain Hot Plasma," filed on Feb. 2, 2010, which is incorporated in the entirety herein by reference.

Figure 1A:
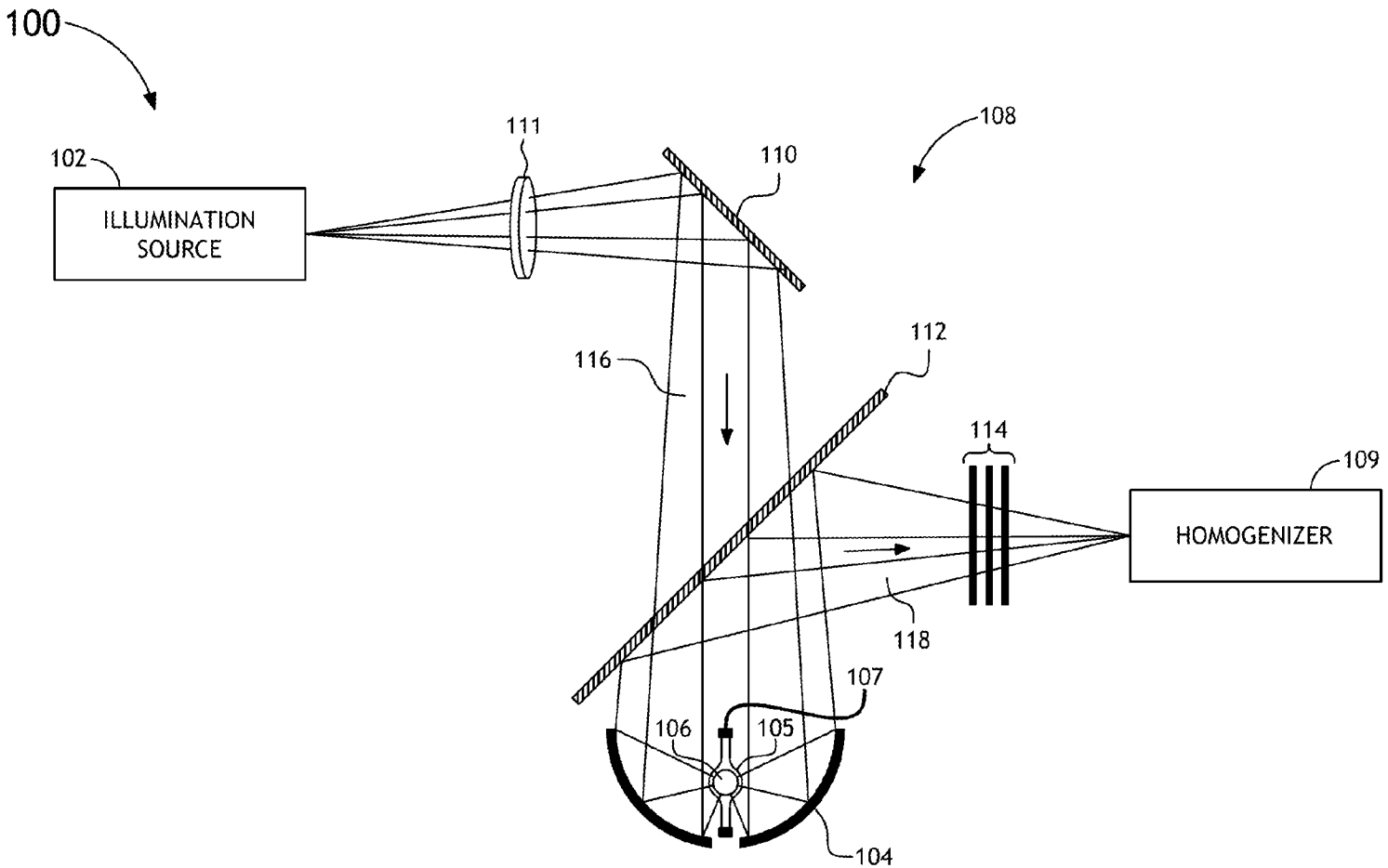
FIG. 1A is block diagram view of a system for sustaining a plasma, in accordance with one embodiment of the present invention.
Figure 1B:
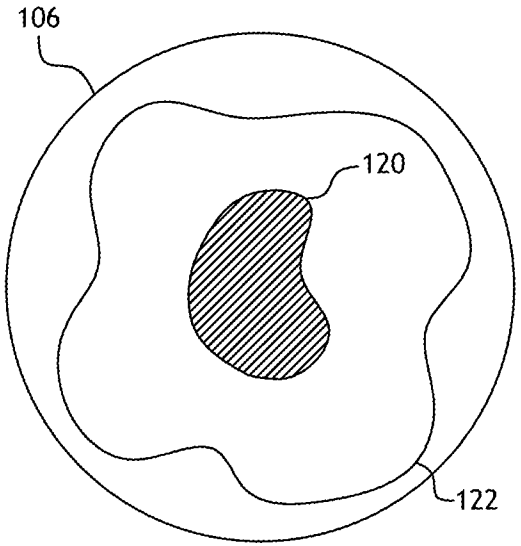
FIG. 1B is a conceptual view of a first plasma species of a first region and a second plasma species of a second region of a volume of gas, in accordance with one embodiment of the present invention.

FIGS. 1A-1B illustrate a system 100 suitable for sustaining a plasma and collecting the light emitted from the plasma, in accordance with one embodiment of the present invention. The system 100 suitable for sustaining a plasma may include an illumination source 102 configured to generate illumination of a first selected wavelength, a volume 106 for containing a gas (e.g., argon, xenon, mercury or the like), and a set of optics 108 configured to focus a portion of the illumination of the first selected wavelength into the volume of gas and collect the emitted light.

In one aspect of the present invention, as shown in FIG. 1B, the volume of gas 106 may include a first plasma species located in a first region 120 of the gas volume 106 and a second plasma species located in a second region 122 of the gas volume 106. In a general sense, the first region 120 consisting of the first plasma species may be enveloped by the second region 122 consisting of the second plasma species. In this sense, the size of the first region 120 of the first plasma species may be smaller than the second region 122 of the second plasma species, with the first region 120 being contained within the second region 122. In another embodiment, the first region 120 of the first species may be at a higher average temperature than the second region 122 of the second species. In this regard, in order to achieve increased plasma brightness the average temperature of the first region 120 (i.e., the inside region) should be higher than the average temperature of the exterior second region 122.

For example, the first species may consist of an ionized state abundant at the higher average temperature of the first region, while the second species consists of a neutral state at the lower average temperature of the second region. Alternatively, the first species may consist of a highly excited neutral state at the higher average temperature of the first region, while the second species consists of a neutral state at the lower average temperature of the second region.

In another aspect of the present invention, the illumination 116 emanating from the illumination source 102 may be tuned to a first selected wavelength such that the illumination is transmitted by the second plasma species 122, while being substantially absorbed by the first plasma species 120. In this regard, the illumination source 102 may be configured to emit illumination 116 having a first selected wavelength tuned to an ion absorption transition line or a highly excited neutral transition of the first plasma species 120, while avoiding the strongest absorption lines associated with the second plasma species 122. In this manner, the illumination source 102 emitting the tuned first selected wavelength may deliver energy predominantly to the first plasma species 120, with little energy being lost to the second region 122, which generally envelopes the first plasma species region 120.

In an alternative embodiment of the present invention, the illumination source 102 may emit illumination across a selected spectral range. In this regard, the selected spectral range of illumination emitted by the illumination source 102 may include one or more wavelengths corresponding to one or more selected absorption lines of the first plasma species 120. For example, the selected range of illumination emitted by the illumination source 102 may include one or more wavelengths corresponding to at least one of an ion absorption transition line or an excited neutral transition line of the first plasma species. In another embodiment, the selected spectral range of illumination emitted by the illumination source 102 may include multiple wavelengths corresponding to multiple selected absorption lines of the first plasma species 120. In a further aspect, selected spectral range of the illumination emitted by the illumination source may be chosen such that the second plasma species 122 is substantially transparent (i.e., avoids most absorption lines associated with second plasma species 122) to the illumination of the selected spectral range.

In another alternative embodiment of the present invention, the illumination source 102 may emit illumination at a plurality of wavelengths. In this regard, the plurality of wavelengths of illumination emitted by the illumination source 102 may include one or more wavelengths corresponding to one or more selected absorption lines of the first plasma species 120. For example, the plurality of wavelengths of illumination emitted by the illumination source 102 may include one or more wavelengths corresponding to at least one of an ion absorption transition line or an excited neutral transition line of the first plasma species. In another embodiment, the plurality of wavelengths of illumination emitted by the illumination source 102 may correspond to multiple selected absorption lines of the first plasma species 120. In a further aspect, plurality of wavelengths of the illumination emitted by the illumination source may be chosen such that the second plasma species 122 is substantially transparent (i.e., avoids most absorption lines associated with second plasma species 122) to the illumination of the plurality of wavelengths.

It is contemplated herein that the present invention may be utilized to sustain a plasma in a variety of gas environments. For example, it is anticipated herein that the volume of gas 106 of the present invention may include argon. For instance, the gas 106 may include a substantially pure argon gas. In another instance, the gas 106 may include a mixture of argon gas with an additional gas. It is further noted that the present invention may be extended to a number of gases. For example, gases suitable for implementation in the present invention may include, but are not limited, to argon, xenon, mercury, and the like. In a further embodiment, a particular gas mixture may be chosen to achieve a level of light absorption in the first plasma species 120 above a predetermined level. Further, a particular gas mixture may be chosen in order to optimize absorption in the first plasma species 120.

Referring again to FIG. 1A, the set of optics 108 of system 100 may include a turning mirror 110, an ellipse 104, one or more lenses 111, and a cold mirror 112. The turning mirror 110 may be configured to receive illumination 116 from the illumination source 102 and direct the illumination to the volume of gas 106 contained within a bulb 105 via ellipse 104. The ellipse 104 may be configured to receive illumination from mirror 110 and focus the illumination to the focal point of the ellipse, wherein the bulb 105 is located.

In a further embodiment, the set of optics 108 may include collection optics configured to collect broadband light 118 emanating from the bulb 105. In this regard, the ellipse 104 may collect and focus the broadband light 118 emanating from the bulb 105 and focus the light 118 into downstream elements, such as a homogenizer 109. In a further embodiment, the system 100 may include a cold mirror 112 configured to direct the broadband light 118 (produced by plasma) from the ellipse to downstream optics, such as a homogenizer 109, while also passing the illumination light 116 to the bulb 105.

In a further embodiment, the set of optics 108 may include one or more additional lenses 111 placed along either the illumination pathway defined by 116 or the collection pathway 118. For instance, one or more lenses 111 positioned along the illumination pathway 116 may be utilized to focus light emanating from the illumination source 102 into the volume of gas. In a further embodiment, the set of optics 108 may include one or more filters 114 placed along either the illumination pathway or the collection pathway in order to filter illumination prior to light entering the plasma bulb 107 or to filter illumination following emission of the light from the bulb 107. It is noted herein that the set of optics 108 as described above and illustrated in FIG. 1A are provided merely for illustration and should not be interpreted as limiting. It is anticipated that a number of equivalent configurations may be utilized to focus illumination 116 into the bulb 105 and subsequently collect broadband light 118 from the bulb 105.

In another aspect of the present invention, the illumination source 102 may include one or more lasers. In a general sense, the illumination source 102 may include any laser system known in the art. For instance, the illumination source 102 may include any laser system known in the art capable of emitting radiation in the infrared, visible or ultraviolet portions of the electromagnetic spectrum. In one embodiment, the illumination source may include a laser system configured to emit continuous wave (CW) laser radiation. For example, in settings where the gas of the volume is or includes argon, the illumination source 102 may include a CW laser (e.g., fiber laser or disc Yb laser) configured to emit radiation at 1069 nm. It is noted that this wavelength fits to a 1068 nm absorption line in argon.

By way of another example, in settings where the gas of the volume is or includes mercury, the illumination source 102 may include a CW laser configured to emit radiation at 964 nm. It is noted herein that the first ion of mercury has an absorption line at 964, with neutral mercury having no transition line at 964. In this regard, in settings including mercury gas, radiation of 964 nm will be substantially transmitted by a second colder region 122 of the gas volume 106, while being substantially absorbed by the first region of the gas, which includes the first plasma species 120.

In another embodiment, the illumination source 102 may include one or more diode lasers. For example, the illumination source 102 may include one or more diode laser emitting radiation at a wavelength corresponding with any one or more absorption lines of the first species 120. For instance, in the case of argon, a diode laser of the illumination source 102 may emit at one of the following wavelengths: 1068, 750, 760, 772, 795, 801, 812, 824, 852, 912, 920, 966, or 1048 nm. It is noted herein that the above listing of wavelengths is not limiting and should be interpreted merely as illustrative. It is contemplated that additional wavelengths may be suitable for pumping argon based plasma of the present invention. It is further recognized that for different types of gases (e.g., xenon, mercury, and the like) used to generate plasma the corresponding wavelengths will be different than those suitable for the case of argon. In a general sense, a diode laser of the illumination source 102 may be selected for implementation such that the wavelength of the diode laser is tuned to any absorption line of any plasma (e.g., ionic transition line) an absorption line of the plasma-producing gas (e.g., highly excited neutral transition line) known in the art. As such, the choice of a given diode laser (or set of diode lasers) will depend on the type of gas utilized to produce the plasma of the present invention.

In another embodiment, the illumination source 102 may include an ion laser. For example, the illumination source 102 may include any noble gas ion laser known in the art. For instance, in the case of an argon-based plasma, the illumination source 102 used to pump argon ions may include an Ar+ laser.

In one another embodiment, the illumination source 102 may include one or more frequency converted laser systems. For example, the illumination source 102 may include a Nd:YAG or Nd:YLF laser having a power level exceeding 100 Watts. In another embodiment, the illumination source 102 may include a broadband laser. In another embodiment, the illumination source may include a laser system configured to emit modulated laser radiation or pulse laser radiation.

In another aspect of the present invention, the illumination source 102 may include one or more non-laser sources. In a general sense, the illumination source 102 may include any non-laser light source known in the art. For instance, the illumination source 102 may include any non-laser system known in the art capable of emitting radiation discretely or continuously in the visible or ultraviolet portions of the electromagnetic spectrum.

In another aspect of the present invention, the illumination source 102 may include two or more light sources. In one embodiment, the illumination source 102 may include two or more lasers. For example, the illumination source 102 (or illumination sources) may include multiple diode lasers. By way of another example, the illumination source 102 may include multiple CW lasers. In a further embodiment, each of the two or more lasers may emit laser radiation tuned to a different absorption line of the first plasma species 120. For example, a first diode laser may be utilized to pump the plasma via absorption through a first absorption line of the first plasma species 120, while at least a second diode laser may be utilized to pump the plasma via absorption through at least a second absorption line of the first plasma species 129.

Figure 2:
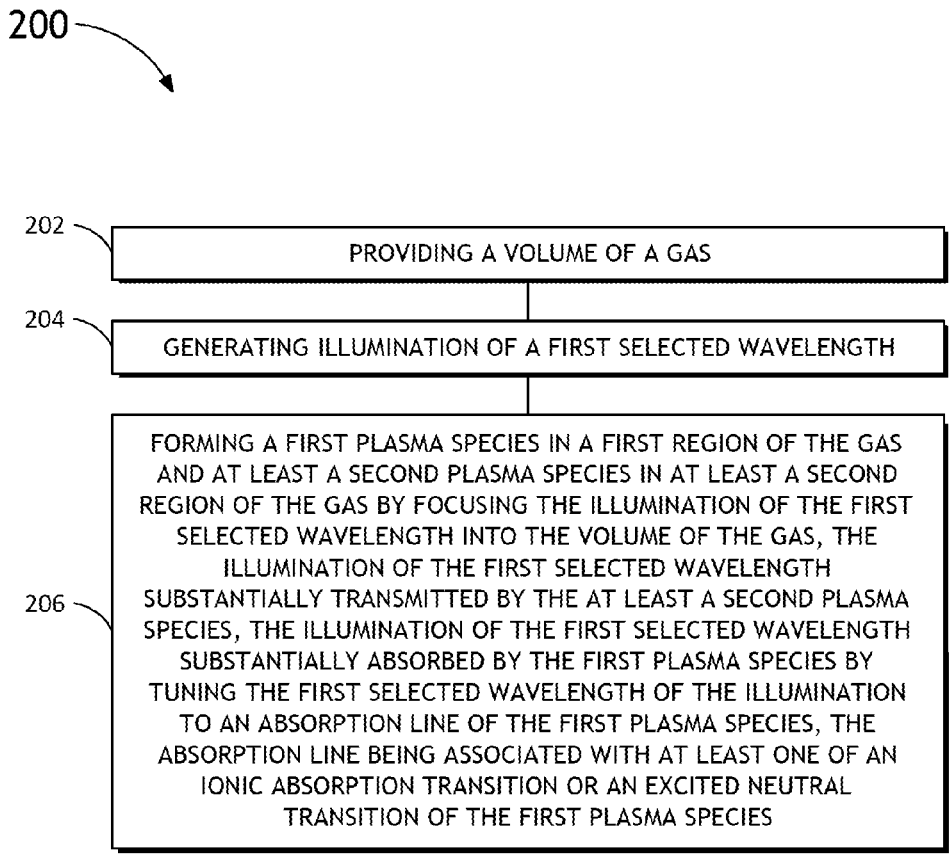
FIG. 2 is a flow diagram illustrating a method for sustaining a plasma, in accordance with one embodiment of the present invention.

FIG. 2 is a flow diagram illustrating steps performed in a method 200 for sustaining a plasma. Applicant notes that the embodiments and enabling technologies described previously herein in the context of system 100 should be interpreted to extend to method 200.

In a first step 202, a volume of a gas is provided. For example, a gas (e.g., pure gas or gas mixture) may be provided and contained within a bulb 105. In a second step 204, illumination of a first selected wavelength is generated. For example, illumination of a selected wavelength may be generated utilizing an illumination source, such as a laser. In a third step 206, a first plasma species may be formed in a first region of the gas and at least a second plasma species may be formed in at least a second region of the gas by focusing the illumination of the first selected wavelength into the volume of the gas. In one aspect, the first region may have a first average temperature and a first size, while the at least a second region may have at least a second average temperature and at least a second size. In another aspect, the illumination of the first selected wavelength is substantially transmitted by the at least a second plasma species. In another aspect, the illumination of the first selected wavelength substantially absorbed by the first plasma species by tuning the first selected wavelength of the illumination to an absorption line of the first plasma species. In a further aspect, the absorption line may correspond to at least one of an ionic absorption transition or an excited neutral transition of the first plasma species.

Figure 3:
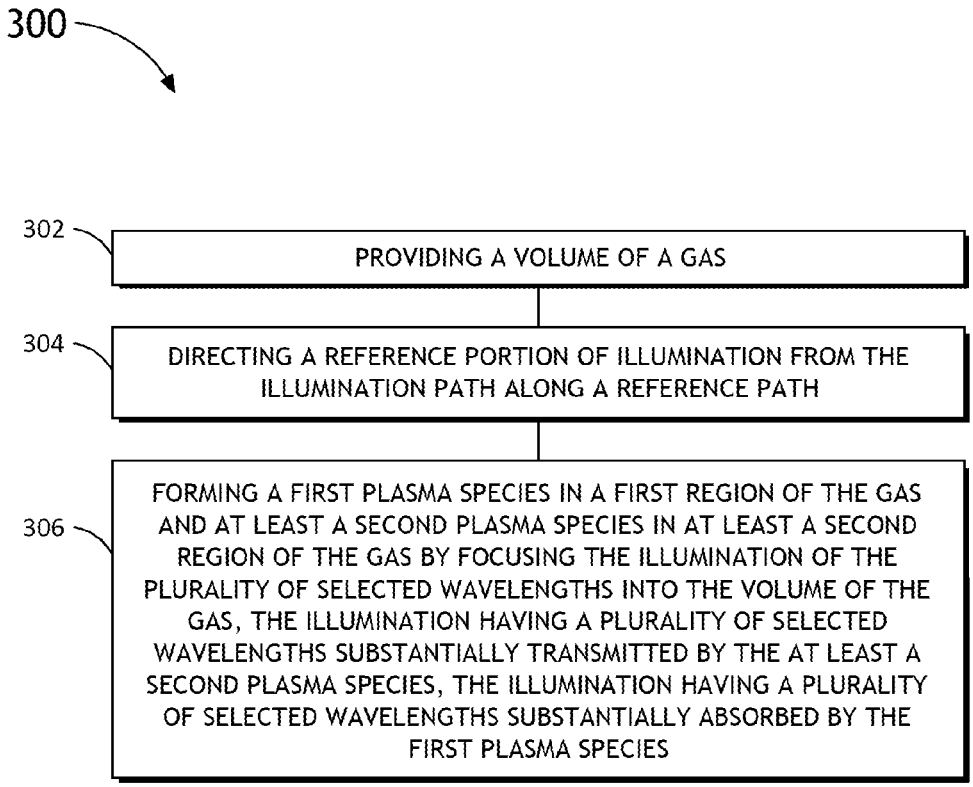
FIG. 3 is a flow diagram illustrating a method for sustaining a plasma, in accordance with one embodiment of the present invention.

FIG. 3 is a flow diagram illustrating steps performed in a method 300 for sustaining a plasma. Applicant notes that the embodiments and enabling technologies described previously herein in the context of system 100 should be interpreted to extend to method 300.

In a first step 302, a volume of a gas is provided. For example, a gas (e.g., pure gas or gas mixture) may be provided and contained within a bulb 105. In a second step 304, illumination of a selected plurality of wavelengths is generated. For example, illumination of the selected plurality of wavelengths may be generated utilizing an illumination source, such as a laser or multiple lasers. In a third step 306, a first plasma species may be formed in a first region of the gas and at least a second plasma species may be formed in at least a second region of the gas by focusing the illumination of the plurality of selected wavelengths into the volume of the gas. In one aspect, the first region may have a first average temperature and a first size, while the at least a second region may have at least a second average temperature and at least a second size. In another aspect, the illumination of the plurality of selected wavelengths is substantially transmitted by the at least a second plasma species. In another aspect, the illumination of the plurality of selected wavelengths is substantially absorbed by the first plasma species by tuning at least some of the selected wavelengths to some of a plurality of transition lines of the second plasma species. In a further aspect, the absorption lines may correspond to at least one of an ionic absorption transition or an excited neutral transition of the first plasma species.

Figure 4:
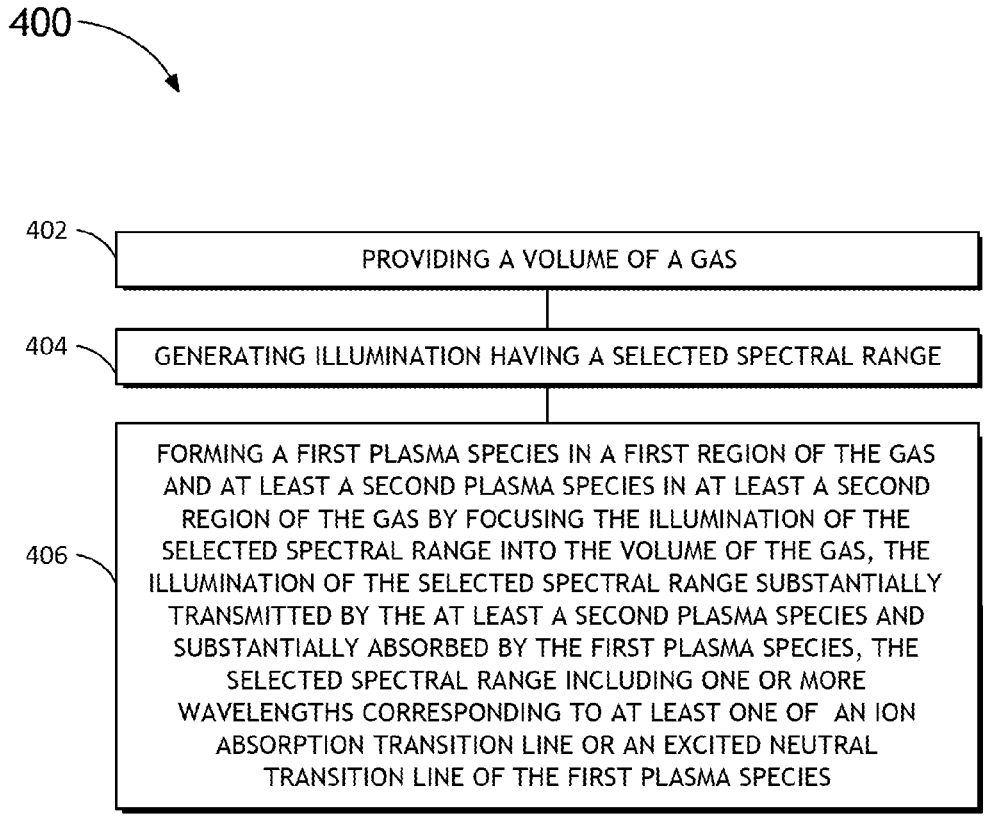
FIG. 4 is a flow diagram illustrating a method for sustaining a plasma, in accordance with one embodiment of the present invention.

FIG. 4 is a flow diagram illustrating steps performed in a method 400 for sustaining a plasma. Applicant notes that the embodiments and enabling technologies described previously herein in the context of system 100 should be interpreted to extend to method 400.

In a first step 402, a volume of a gas is provided. For example, a gas (e.g., pure gas or gas mixture) may be provided and contained within a bulb 105. In a second step 404, illumination of a selected spectral range is generated. For example, illumination of the selected spectral range may be generated utilizing an illumination source, such as a broadband or multiple lasers. In a third step 406, a first plasma species may be formed in a first region of the gas and at least a second plasma species may be formed in at least a second region of the gas by focusing the illumination of the selected spectral range into the volume of the gas. In one aspect, the first region may have a first average temperature and a first size, while the at least a second region may have at least a second average temperature and at least a second size. In another aspect, the illumination of the selected spectral range is substantially transmitted by the at least a second plasma species. In another aspect, the illumination of the selected spectral range is substantially absorbed by the first plasma species. In another aspect, the selected spectral range includes one or more wavelengths corresponding to at least one of an ion absorption transition line or an excited neutral transition line of the first plasma species. In a further aspect, the absorption lines may correspond to at least one of an ionic absorption transition or an excited neutral transition of the first plasma species.

Figure 5:
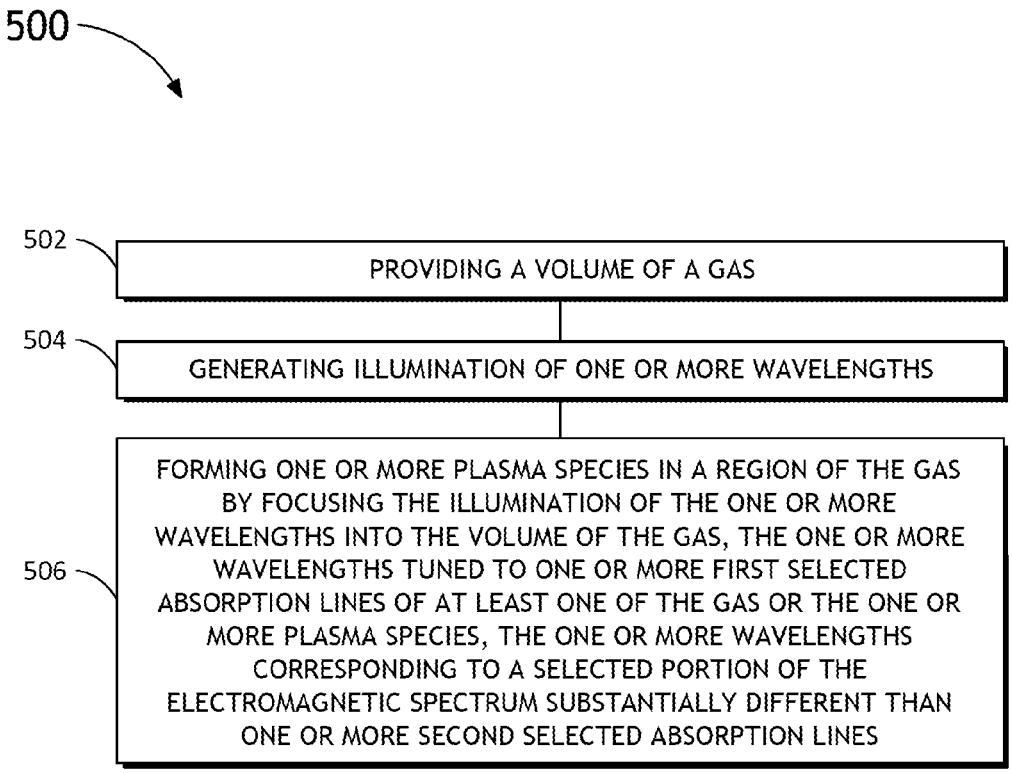
FIG. 5 is a flow diagram illustrating a method for sustaining a plasma, in accordance with one embodiment of the present invention.

FIG. 5 is a flow diagram illustrating steps performed in a method 500 for sustaining a plasma. Applicant notes that the embodiments and enabling technologies described previously herein in the context of system 100 should be interpreted to extend to method 500.

In a first step 502, a volume of a gas is provided. For example, a gas (e.g., pure gas or gas mixture) may be provided and contained within a bulb 105. In a second step 504, illumination of one or more selected wavelengths is generated. For example, illumination of the one or more selected wavelengths may be generated utilizing an illumination source, such as a laser or multiple lasers. In a third step 506, a first plasma species may be formed in a first region of the gas and at least a second plasma species may be formed in at least a second region of the gas by focusing the illumination of the one or more selected wavelengths into the volume of the gas. In one aspect, the first region may have a first average temperature and a first size, while the at least a second region may have at least a second average temperature and at least a second size. In another aspect, the illumination of the one or more selected wavelengths is substantially transmitted by the at least a second plasma species. In another aspect, the illumination of the one or more selected wavelengths is substantially absorbed by the first plasma species by tuning one or more wavelengths to one or more first selected absorption lines of at least one of the gas or the one or more plasma species, the one or more wavelengths corresponding to a selected portion of the electromagnetic spectrum substantially different than one or more second selected absorption lines.

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors. A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

Furthermore, it is to be understood that the invention is defined by the appended claims.

What is claimed:

1. A method for sustaining a plasma, comprising:

providing a volume of a gas;

generating illumination of a first selected wavelength; and forming a first plasma species in a first region of the gas and at least a second plasma species in at least a second region of the gas by focusing the illumination of the first selected wavelength into the volume of the gas, the first region having a first average temperature and a first size, the at least a second region having at least a second average temperature and at least a second size, the illumination of the first selected wavelength substantially transmitted by the at least a second plasma species, the illumination of the first selected wavelength substantially absorbed by the first plasma species by tuning the first selected wavelength of the illumination to an absorption line of the first plasma species, the absorption line being associated with at least one of an ionic absorption transition or an excited neutral transition of the first plasma species.

2. The method of claim 1, wherein the first average temperature of the first plasma species is larger than the at least a second average temperature of the at least a second plasma species.

3. The method of claim 1, wherein the first size of the first region is smaller than the at least a second size of the at least a second region.

4. The method of claim 1, further comprising:

adjusting an average temperature of the gas in order to adjust the strength of one or more absorption lines of at least one of the first plasma species or the second plasma species.

5. The method of claim 1, wherein the generating illumination of a first selected wavelength comprises:

generating illumination of a first selected wavelength utilizing one or more lasers.

6. The method of claim 1, wherein the gas comprises:

at least one of argon, xenon and mercury.

7. A method for sustaining a plasma, comprising:

providing a volume of a gas;

generating illumination including a plurality of selected wavelengths;

forming a first plasma species in a first region of the gas and at least a second plasma species in at least a second region of the gas by focusing the illumination of the plurality of selected wavelengths into the volume of the gas, the first region having a first average temperature and a first size, the at least a second region having at least a second average temperature and at least a second size, the illumination having one or more of the plurality of selected wavelengths substantially transmitted by the at least a second plasma species, the illumination having a plurality of selected wavelengths substantially absorbed by the first plasma species.

8. The method of claim 7, wherein the plurality of transition lines comprises:

at least one of an ion absorption transition line or an excited neutral transition line.

9. A method for sustaining a plasma, comprising:

providing a volume of a gas;

generating illumination having a selected spectral range;

forming a first plasma species in a first region of the gas and at least a second plasma species in at least a second region of the gas by focusing the illumination of the selected spectral range into the volume of the gas, the first region having a first average temperature and a first size, the at least a second region having at least a second average temperature and at least a second size, the illumination of the selected spectral range substantially transmitted by the at least a second plasma species and substantially absorbed by the first plasma species, the selected spectral range including one or more wavelengths corresponding to at least one of an ion absorption transition line or an excited neutral transition line of the first plasma species.

10. A method for sustaining a plasma, comprising:

providing a volume of a gas;

generating illumination of one or more selected wavelengths, forming one or more plasma species in a region of the gas by focusing the illumination of the one or more wavelengths into the volume of the gas, the one or more wavelengths tuned to one or more first selected absorption lines of at least one of the gas or the one or more plasma species, the one or more wavelengths corresponding to a selected portion of the electromagnetic spectrum substantially different than one or more second selected absorption lines.

11. The method of claim 10, wherein the one or more first selected absorption lines comprises:

an ionized transition line.

12. The method of claim 10, wherein the one or more first selected absorption lines comprises:

an excited neutral transition line.

13. An apparatus for sustaining a plasma, comprising:

a volume for containing a gas;

an illumination source configured to generate illumination of a first selected wavelength;

a first set of optics configured to focus a portion of the illumination of the first selected wavelength into the volume of gas in order to form a first plasma species in a first region of the gas and at least a second plasma species in at least a second region of the gas, the first region having a first average temperature and a first size, the at least a second region having at least a second average temperature and at least a second size, the illumination of the first selected wavelength substantially transmitted by the at least a second plasma species, the illumination of the first selected wavelength substantially absorbed by the first plasma species by tuning the first selected wavelength of the illumination to at least one of an ion absorption transition line or an excited neutral transition line of the second plasma species.

14. The apparatus of claim 13, wherein the first average temperature of the first plasma species is larger than the at least a second average temperature of the at least a second plasma species.

15. The apparatus of claim 13, wherein the first size of the first region is smaller than the at least a second size of the at least a second region.

16. The apparatus of claim 13, wherein the illumination source comprises:

one or more lasers.

17. The apparatus of claim 13, wherein the one or more lasers comprise:

at least one of a diode laser, a continuous wave laser, or a broadband laser.

18. The method of claim 13, wherein the gas comprises:

at least one of argon, xenon and mercury.

* * * * *